United States Patent [19]

Suzuki et al.

[11] 4,134,692

[45] Jan. 16, 1979

[54] HIGH SPEED IMPACT PRINTER

[75] Inventors: Takami Suzuki; Takashi Fukushima, both of Tokyo, Japan

[73] Assignee: Ricoh Co., Ltd., Tokyo, Japan

[21] Appl. No.: 806,145

[22] Filed: Jun. 13, 1977

[30] Foreign Application Priority Data

Jun. 14, 1976 [JP] Japan ..... 51-68699

[51] Int. Cl.[2] ..... B41J 7/92

[52] U.S. Cl. ..... 400/144.2; 400/57; 101/93.03

[58] Field of Search ..... 197/18, 53, 54, 49; 101/93.03, 93.19, 93.22; 400/144.2, 57

[56] References Cited

U.S. PATENT DOCUMENTS

| | | | |
|---|---|---|---|
| 3,707,214 | 12/1972 | Ponzano | 197/53 |
| 3,858,509 | 1/1975 | Grundherr | 101/93.03 |
| 4,030,591 | 6/1977 | Martin et al. | 197/53 |
| 4,037,208 | 7/1977 | Osterlund et al. | 197/53 X |
| 4,058,195 | 11/1977 | Fravel et al. | 197/53 X |

OTHER PUBLICATIONS

Mathews, IBM Tech. Discl. Bulletin, vol. 18, No. 11, Apr. 1976, pp. 3533-3534.

*Primary Examiner*—Edward M. Coven
*Attorney, Agent, or Firm*—David G. Alexander

[57] ABSTRACT

A type wheel comprises a rotary hub, a plurality of resilient, circumferentially spaced arms extending radially outwardly from the hub and a plurality of type elements provided at the end portions of the respective arms. The type wheel is rotated until the selected type element reaches a printing position relative to a platen. One or more sheets of paper interspersed with carbon sheets are wound around the platen for printing. A lever is positioned to adjust the distance between the type wheel and the platen in accordance with the number of sheets. A printing hammer is electromagnetically actuated to resiliently move the selected arm so that the respective type element impacts against the paper through an inked ribbon to print the desired character. The length of time required for the hammer to clear the non-selected arms of the type wheel after impact is a function of the number of sheets of paper and thereby the position of the lever. An electrical circuit computes this length of time and inhibits rotation of the type wheel thereduring.

8 Claims, 9 Drawing Figures

PRINTING AREA DECODER
INHIBIT DECODER
INHIBIT TIMER
HAMMER DRIVER
TYPE WHEEL DRIVER
PULSE GENERATOR
81
82
83
84
86
37
41
42
43
44'
46
47
48'
71'
13
24
P1
P2
P3
P4
P5
I1
I2
I3
I4
I5
I6

HIGH SPEED IMPACT PRINTER

BACKGROUND OF THE INVENTION

The present invention relates to a high speed impact printer.

Printers comprising resilient type wheels are becoming increasingly popular in the art due to their many advantages. These type wheels comprise a rotary hub with a plurality of resilient arms extending therefrom in a spoke-like manner. Type elements are provided at the end portions of the arms. These type wheels can be fabricated at very low cost and provide high speed, effective printing.

The type wheel is rotated until the selected type element is in a printing position relative to a platen around which paper is wound. A hammer is driven to engage the selected type element and drive the same to impact against the paper through an inked ribbon, thereby printing the desired character. The selected arm resiliently bends during this process. After impact the type element and hammer return to their original positions due to the resilience of the arm and a return spring for the hammer.

At impact, the hammer intersects a plane containing the non-selected type elements. If the type wheel were rotated at this time the arm next to the selected arm would strike the hammer causing a jam, breakage of one or more arms or both. The hammer must be retracted to such an extent as to clear the type wheel before the type wheel can be rotated for selection of the next character for printing.

Although such printers are often operated to print only one sheet of paper, it is sometimes desired to make several copies by means of interspersed sheets of ordinary paper and carbon paper. The distance between the type wheel and the platen is adjusted by means of a lever according to the number of sheets or copies to be printed. Since a large number of sheets has a cushioning effect on the type wheel and hammer thereby absorbing impact energy, the hammer returns more slowly after impact when a large number of sheets are printed. Thus, rotation of the type wheel must be inhibited for a longer length of time after impact when a large number of sheets are printed.

Prior art printers are set up to inhibit rotation of the type wheel for the maximum length of time it could possibly take the hammer to clear the type wheel after impact, which necessarily corresponds to the maximum number of sheets which can be printed by the printer. This constitutes a waste of operating time where only one sheet or an intermediate number of sheets is printed since the printer remains idle for a length of time equal to the difference between said maximum length of time and the actual length of time it takes the hammer to clear the type wheel. In other words, the printer operates at its maximum possible speed only when the maximum number of sheets are being printed, and is unnecessarily prevented from being speeded up where less than the maximum number of sheets are being printed.

SUMMARY OF THE INVENTION

In accordance with the present invention a type wheel comprises a rotary hub, a plurality resilient, circumferentially spaced arms extending radially outwardly from the hub and a plurality of type elements provided at the end portions of the respective arms. The type wheel is rotated until the selected type element reaches a printing position relative to a platen. One or more sheets of paper interspersed with carbon sheets are wound around the platen for printing. A lever is positioned to adjust the distance between the type wheel and the platen in accordance with the number of sheets. A printing hammer is electromagnetically actuated to resiliently move the selected arm so that the respective type element impacts against the paper through an inked ribbon to print the desired character. The length of time required for the hammer to clear the non-selected arms of the type wheel after impact is a function of the number of sheets of paper and thereby the position of the lever. An electrical circuit computes this length of time and inhibits rotation of the type wheel thereduring. In one form of the invention, the printing area of the selected character is also utilized as a parameter in the computation time of the inhibition of the type wheel rotation.

It is an object of the present invention to provide a printing apparatus which is operable at higher speed than prior art printing apparatus of the same general configuration.

It is another object of the present invention to provide a high speed printing apparatus which positively prevents breakage of a type wheel and jams of the printer mechanism.

It is another object of the present invention to eliminate a cause of inefficient operation of a printing apparatus.

It is another object of the present invention to provide a generally improved high speed printing apparatus.

Other objects, together with the foregoing, are attained in the embodiments described in the following description and illustrated in the accompanying drawing.

DESCRIPTION OF THE PREFERRED EMBODIMENTS

While the high speed printing apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
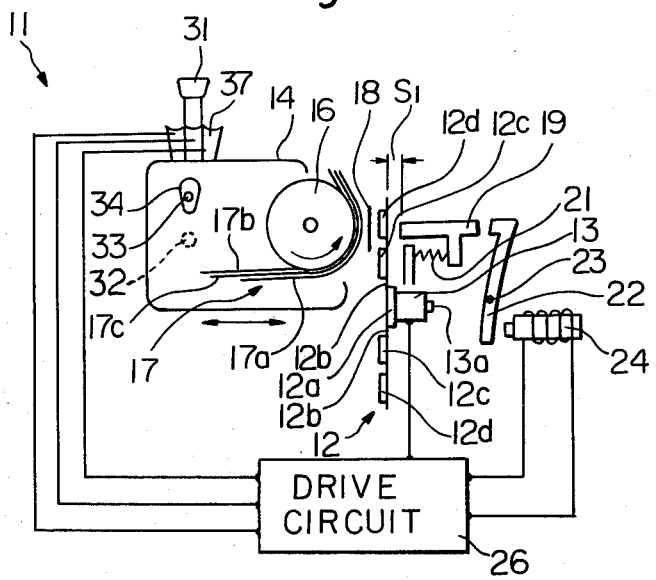
FIG. 1 is an overall schematic view of a high speed printing apparatus embodying the present invention.

Referring now to FIG. 1 of the drawing a high speed impact printer embodying the present invention is generally designated by the reference numeral 11 and comprises a type wheel 12. The type wheel 12 comprises a rotary hub 12*a* and a plurality of resilient arms 12*b* which extend radially from the hub 12*a*. Although not visible in the drawing, the arms 12*b* are circumferentially spaced about the axis of the hub 12*a* in a plane perpendicular to the drawing. The hub 12*a* is fixed to a shaft 13*a* of a type selection drive motor 13 for integral rotation.

A radially inner type element 12*c* and a radially outer type element 12*d* are provided on each arm 12*b*. The entire type wheel 12 may be fabricated as a unit by a molding process of a resilient resinous or plastic material, and the faces of the type elements 12*c* and 12*d* coated with a hard material such as a metal or thermosetting resin to resist deformation and wear.

The type elements 12*c* and 12*d* have faces (not visible) formed as alphanumeric characters, symbols and the like as desired for the particular application, which face a carriage 14. The carriage 14 carries a rotary platen 16 which is movable with the carriage 14 in a unitary manner perpendicular to the plane of the drawing for character spacing. The platen 16 is rotatable counterclockwise for line spacing. Furthermore, the type wheel 12 is movable vertically relative to the carriage 14. For printing, the selected arm 12*b* is moved to a printing position by the motor 13 in which it extends vertically upwardly. The type wheel 12 is moved vertically so that the selected type element 12*c* or 12*d* on the selected arm 12*b* is adjacent to the platen 16. Typically, the type elements 12*c* may constitute upper case letters and the type elements 12*d* may constitute lower case letters.

One or more sheets of paper 17 are wound around the platen 16 for printing, depending on the number of printed copies desired. As shown, two sheets 17*a* and 17*b* of ordinary paper are interspersed with a sheet 17*c* of carbon paper around the platen 16 to provide two printed copies. An inked ribbon 18 is disposed between the type wheel 12 and the platen 16.

A printing hammer 19 is supported for movement toward and away from the type wheel 12, and is urged rightwardly by a compression type hammer return spring 21. Normally the left end of the hammer 19 is held away from the facing portion of the type wheel 12 in a rest position by a distance S1 by the spring 21. A hammer actuating lever 22 is pivotal about an intermediate fulcrum pin 23 and has an upper end portion (not designated) which is engageable with the right end of the hammer 19. An electromagnet 24 is provided adjacent to the lower end portion (not designated) of the lever 22.

To print the selected character, the type wheel 12 is rotated and moved vertically by a drive circuit 26 until the selected type element 12*c* or 12*d* is moved to the printing position between the hammer 19 and the platen 16. The electromagnet 24 is energized by the drive circuit 26 and attracts the lower end portion of the lever 22, causing the same to pivot counterclockwise. The upper end portion of the lever 22 engages with the hammer 19 and moves the same leftwardly into engagement with the selected type element 12*c* or 12*d*. Further leftward movement of the hammer 19 causes the selected type element 12*c* or 12*d* to impact against the sheets 17*a* to 17*c*, thereby printing the selected character. The selected arm 12*b* resiliently bends allowing movement of the type elements 12*c* and 12*d*. After impact, the selected arm 12*b* and type elements 12*c* and 12*d* return to their initial positions due to the rebound force and resilience of the arm 12*b*. The hammer 19 is returned to the rest position thereof due to rebound force, the resilience of the arm 12*b* exerted thereon and the force of the return spring 21.

As discussed hereinabove, it is necessary that the left end of the hammer 19 be spaced from the rest position by no more than the distance S1 before the type wheel 12 is rotated to select the next character for printing. Otherwise, the hammer 19 would intersect the plane passing through the rightmost portion of the arms 12*b* and type elements 12*c* and 12*d* and the arm 12*b* adjacent to the selected arm 12*b* would strike the hammer 19 causing a jam of the printing mechanism and/or breakage of one or more arms 12*c*. In other words, the hammer 19 must clear the type wheel 12 after impact with the paper 17 before the type wheel 12 can be rotated for selection of the next character.

The time required for the hammer 19 to return to its rest position after impact is a function of the number of sheets printed, due to the cushioning effect of the paper 17. The larger the number of sheets, the greater the cushioning effect.

Figure 2:
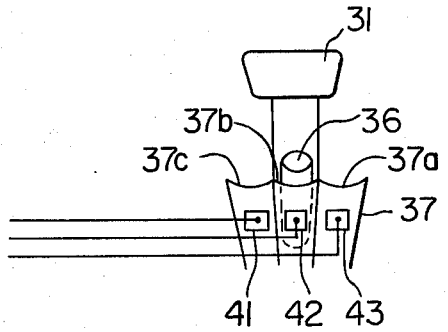
FIG. 2 is an enlarged schematic view of an adjustment mechanism of the printing apparatus shown in fragmentary form.

An adjusting lever 31 which is shown in enlarged scale in FIG. 2 is pivotally mounted about a shaft 32. A pin 33 fixed to the adjusting lever 31 engages in a slot 34 formed in the carriage 14. Where a large number of sheets are to be printed, the carriage 14 and platen 16 are moved away from the type wheel 12 and the inked ribbon 18.

As shown by way of example, the lever 31 is provided with a detent projection 36. A detent member 37 is mounted on the carriage 14 and is formed with three detent recesses 37*a*, 37*b* and 37*c* in which the detent projection 36 is selectively engageable. For printing one sheet of paper, the adjusting lever 31 is pivoted clockwise so that the detent projection 36 engages in the detent recess 37*a*. The pin 33 and the carriage 14 are moved rightwardly so that the platen 16 is moved toward the type wheel 12 to a maximum extent. For printing three sheets (three sheets of ordinary paper with two interspersed sheets of carbon paper to produce two printed copies) the adjusting lever 31 is pivoted counterclockwise so that the detent projection 36 engages in the detent recess 37*b*, thereby moving the platen 16 away from the type wheel 12 to an intermediate extent. To print five sheets (five sheets of ordinary paper with four interspersed sheets of carbon paper to produce four printed copies) the lever 31 is moved counterclockwise so that the detent projection 36 engages in the detent recess 37*c* and the platen 16 is moved away from the type wheel 12 to a maximum extent.

Figure 4:
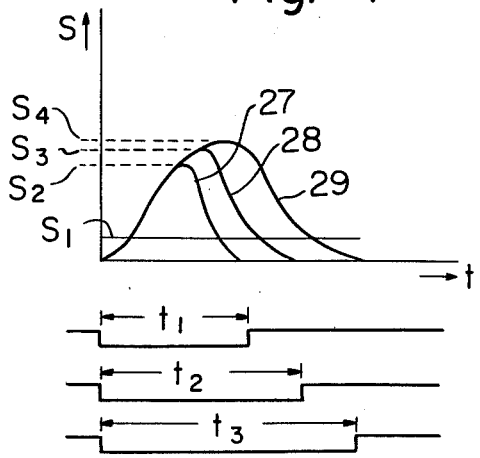
FIG. 4 is a graph illustrating the operation of the embodiment of FIG. 1.

FIG. 4 shows the relationship between the distance S of the left end of the hammer 19 from its rest position as a function of time t and the number of sheets printed. Curves 27, 28 and 29 indicate that the detent projection 36 engages in the detent recesses 37*a*, 37*b* and 37*c* for printing 1, 3 and 5 sheets respectively.

It will be seen from examination of the curve 27 that for printing one sheet the hammer 19 impacts against the paper 17 at a distance S2 from its rest position and returns to its rest position in a time duration t1 after initiation of movement. For printing three sheets, the hammer 19 moves through a distance S3 and returns to its rest position in a time duration t2. t2 > t1 because S3 > S2 and also because the cushioning effect of three sheets is greater than that of one sheet. For printing five sheets, the hammer 19 moves through a distance S4 and returns in a time duration t3, with S4 and t3 having maximum values.

In a conventional printing apparatus which generally comprises a type wheel and hammer resembling the type wheel 12 and hammer 19, the apparatus is adjusted so that the type wheel is prevented from rotation to select the next character for the maximum time duration t3 after initiation of hammer movement to ensure that the type wheel will not be rotated until the hammer is clear thereof. While this expedient allows maximum printing speed where the maximum number of sheets are printed (in this example five sheets), it is clear that operating time is wasted when a smaller number of sheets are printed. For printing three sheets, the apparatus is unnecessarily maintained idle for a time duration equal to t3 - t2 each time a character is printed. A maximum time duration t3 - t1 is wasted where only one sheet is printed.

Figure 3:
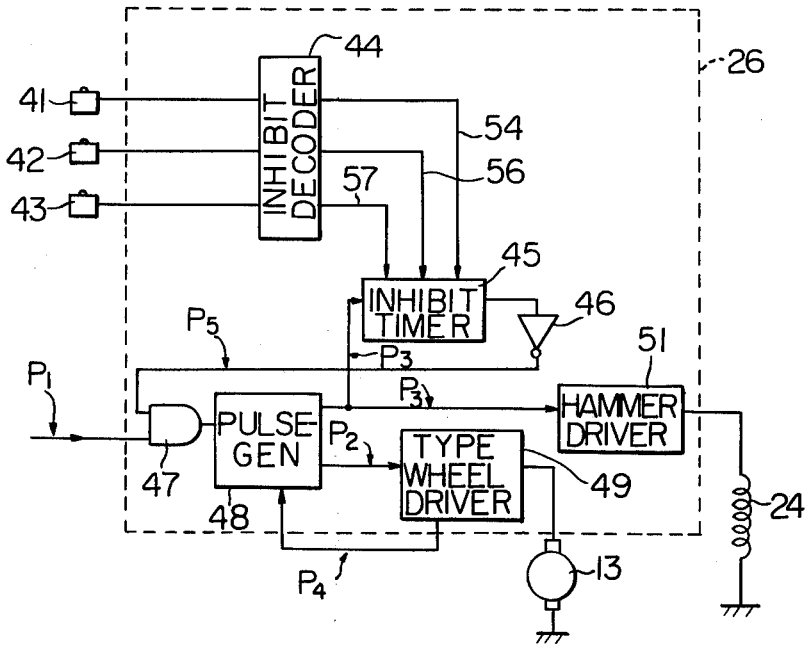
FIG. 3 is an electrical schematic diagram of the present printing apparatus.

With reference further being made to FIG. 3, it will be disclosed how the present invention overcomes these drawbacks of the prior art. In accordance with the present invention, microswitches 41, 42 and 43 are provided to the detent recesses 37*a*, 37*b* and 37*c* respectively. The microswitches 41, 42 and 43 are normally open and are closed by the detent projection 36 when the same engages in the respective detent recess 37*a*, 37*b* or 37*c*.

The microswitches 41, 42 and 43 are connected to inputs of an inhibit decoder 44, outputs of which are connected to corresponding inputs of an inhibit timer 45. The output of the inhibit timer 45 is connected through an inverter 46 to an input of an AND gate 47. Another input of the AND gate 47 is connected to receive a print pulse signal $P_1$ which is generated in another portion of the apparatus 11 (not shown). The print signal $P_1$ is generated to cause the apparatus 11 to print a character. The means for generating the print signal $P_1$ are not the subject matter of the present invention and are not shown.

The output of the AND gate 47 is connected to an input of a pulse generator 48 which generates a type selection pulse signal $P_2$ in response to the print signal $P_1$ gated through the AND gate 47. The motor 13 is typically of the stepping type. The type selection pulse $P_2$ from the pulse generator 48 is fed to an input of a type wheel driver 49, the output of which is connected to the motor 13. Although not shown, a signal indicating the character to be printed is fed to the type wheel driver 49 from another section of the apparatus 11. The type wheel driver 49 computes the number of steps the type wheel 12 must be rotatably driven from the initial position thereof to a position such that the selected arm 12*b* occupies the printing position and feeds a number of stepping pulses to the motor 13 corresponding thereto. When the type wheel 12 reaches the required position, the type wheel driver 49 feeds a signal $P_4$ back to the pulse generator 48 indicating the same.

In response to the signal $P_4$, the pulse generator 48 feeds a hammer drive pulse signal $P_3$ to a hammer driver 51, which energizes the electromagnet 24 in response thereto to print the desired character. The signal $P_3$ is also fed to a trigger input of the inhibit timer 45.

The inhibit decoder 44 produces output signals corresponding to which microswitch 41, 42 or 43 is closed. The outputs applied from the inhibit decoder 44 to the inhibit timer 45 determine the timing interval of the inhibit timer 45. With the microswitch 41, 42 or 43 closed, the timing interval of the inhibit timer 45 is t1, t2 or t3 respectively. The inhibit timer 45 is triggered by the signal $P_3$ from the pulse generator 48 and produces a high output for the selected time duration t1, t2 or t3. The high output of the inhibit timer 45 inverted by the inverter 46 to constitute a logically low inhibit signal which is applied to the input of the AND gate 47 to inhibit the same. Thus, a subsequent signal $P_1$ cannot be gated through the AND gate 47 to the pulse generator 48 to cause rotation of the type wheel 12 until termination of the duration t1, t2 or t3, or until the hammer 19 returns to its rest position after impact with the paper 17 for printing.

In summary, it will be seen that the drive circuit 26 is prevented from accepting any further print signals $P_1$ during the time required for the hammer 19 to complete the printing operation and return to its rest position clear of the type wheel 12. This inhibit time is a function of the number of sheets printed and is therefore minimized where only one sheet is to be printed. Thus, the printing speed can be increased (print signals accepted by the drive circuit 26 at a faster rate) where only one or a number less than the maximum number of sheets is to be printed.

After the duration t1, t2 or t3 has elapsed, the output of the inhibit timer 45 goes low and the output of the inverter 46 goes high. It may be considered that the logically low inhibit signal is terminated. With the high output of the inverter 46 applied to the AND gate 47, a subsequent print signal $P_1$ may be gated through the AND gate 47 to the pulse generator 48 to print a subsequent character.

Figure 5:
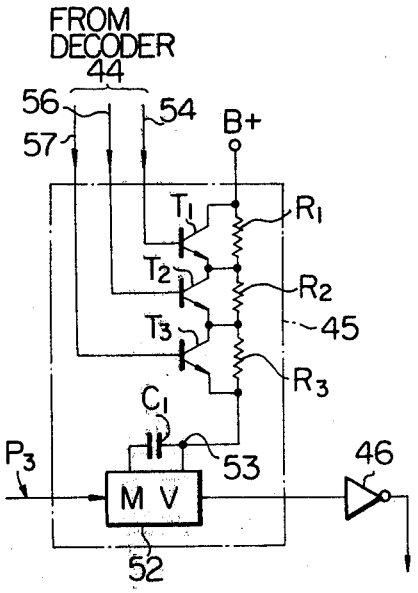
FIG. 5 is an electrical schematic diagram of a first embodiment of an inhibit timer of the printing apparatus.

As shown in FIG. 5, the inhibit timer 45 comprises a monostable multivibrator 52 connected between the pulse generator 48 and the inverter 46. The duration of the pulse produced by the multivibrator 52 in response to the signal $P_3$ is determined by a timing capacitor $C_1$ which charges through resistors $R_1$, $R_2$ and $R_3$ connected in series between a terminal 53 of the capacitor $C_1$ and a voltage source B+.

The collector circuits of NPN transistors $T_1$, $T_2$ and $T_3$ are connected across the resistors $R_1$, $R_2$ and $R_3$ respectively. Outputs of the inhibit decoder 44 corresponding to closure of the microswitches 41, 42 and 43 are connected to the bases of the transistors $T_1$, $T_2$ and $T_3$ through lines 54, 56 and 57 respectively. The resistance values of the resistors $R_1$, $R_2$ and $R_3$ are selected so that $R_1 > R_2 > R_3$.

The terminal 53 is normally maintained at ground potential by the internal circuitry (not shown) of the multivibrator 52 so that the capacitor $C_1$ is discharged. In response to the signal $P_3$ the terminal 53 is ungrounded and the output of the multivibrator 52 goes high. The capacitor $C_1$ charges through various combinations of the resistors $R_1$, $R_2$ and $R_3$ as will be described below.

When the voltage across the capacitor $C_1$ reaches a certain value the output of the multivibrator 52 goes low and the terminal 53 is grounded, discharging the capacitor $C_1$. Thus, the multivibrator 52 produces a high output from the time the pulse signal $P_3$ is received to the time the voltage across the capacitor $C_1$ reaches the predetermined value.

The charging rate of the capacitor $C_1$ is determined by the resistance connected in series therewith. With the microswitch 41 closed, the output of the decoder 44 on the line 54 is high turning on the transistor $T_1$. This shorts out the resistor $R_1$ through the low resistance of the collector circuit of the transistor $T_1$. Since the resistance of the resistor $R_1$ is large, the resistance in series with the capacitor $C_1$ is decreased to a maximum extent and the capacitor $C_1$ charges at the maximum speed. The time required for the capacitor $C_1$ to charge to the predetermined voltage with the resistor $R_1$ shorted out is selected to be equal to t1.

In a similar manner, with the microswitch 42 closed the output on the line 56 is high and the transistor $T_2$ is turned on shorting out the resistor $R_2$. Since the resistance of the resistor $R_2$ is intermediate between the values of the resistors $R_1$ and $R_3$, the resistance in series with the capacitor $C_1$ is reduced to an intermediate extent, and the capacitor $C_1$ is charged to the predetermined value in the time T2. With the switch 43 closed, the high signal on the line 57 turns on the transistor $T_3$ which shorts out the resistor $R_3$. The resistance of the resistor $R_3$ is small and the effect on the resistance in series with the capacitor $C_1$ is minimum. Therefore, the capacitor $C_1$ charges to the predetermind value in the maximum time t3.

Figure 6:
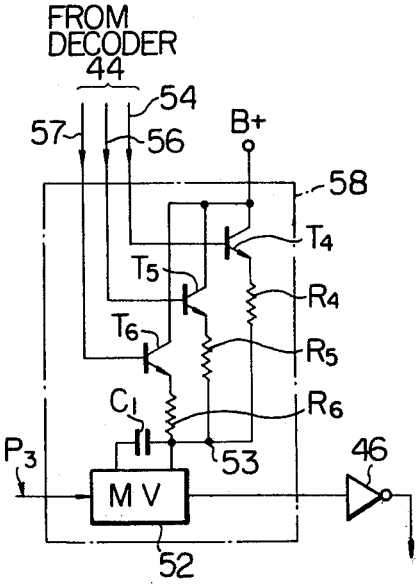
FIG. 6 is similar to FIG. 5 but shows a second embodiment of the inhibit timer.

FIG. 6 shows a variation of the circuit of FIG. 5. An inhibit timer 58 comprises the same multivibrator 52 and capacitor $C_1$ as the timer 45. However, in the timer 58 NPN transistors $T_4$, $T_5$ and $T_6$ are connected in series with resistors $R_4$, $R_5$ and $R_6$ between B+ and the terminal 53. The values of the resistors $R_4$, $R_5$ and $R_6$ are selected so that $R_4 < R_5 < R_6$.

With the microswitch 41 closed and the transistor $T_4$ turned on, the capacitor $C_1$ charges through the transistor $T_4$ and resistor $R_4$. Since the resistor $R_4$ has the smallest value, the capacitor $C_1$ charges at a maximum rate corresponding to the time duration t1. With the microswitch 42 closed the capacitor $C_1$ charges through the intermediate value resistor $R_2$ corresponding to time t2. With the microswitch 43 closed the capacitor $C_1$ charges through the maximum value resistor $R_3$ corresponding to time t3.

Figure 7:
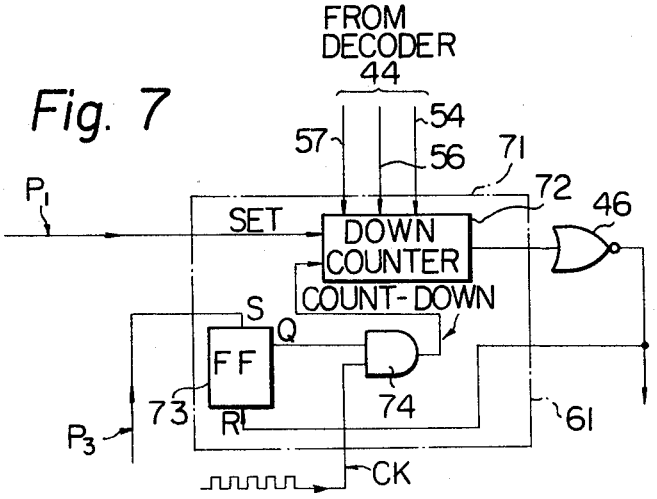
FIG. 7 is also similar to FIG. 5 but shows a third embodiment of the inhibit timer.

FIG. 7 shows another inhibit timer 71 comprising a binary counter 72. A set input of the counter 72 is connected to receive the pulse $P_1$. Although the internal circuitry of the counter 72 is not the subject matter of the present invention and is not shown, the counter 72 is adapted to count down in response to clock pulses applied to a countdown input thereof. The counter 72 comprises a latch connected to the lines 54, 56 and 57 and a decoder. In response to the pulse $P_1$ the signals on the lines 54, 56 and 57 are latched into the counter 72 and decoded in such a manner that the initial count of the counter 72 is set in accordance therewith. For example, with the lines 54, 56 or 57 logically high the initial count of the counter 72 may be set to "3", "5" or "7" corresponding to the time durations t1, t2 and t3 respectively. An output of the counter 72 which is connected to the inverter 46 is high whenever the instantaneous count in the counter 72 is not equal to the initial count which is latched in and decoded and is furthermore not equal to zero.

The hammer drive pulse $P_3$ is fed to a set input of a flip-flop 73. The output of the inverter 46 is connected to a reset input of the flip-flop 73. The "Q" output of the flip-flop 73 is connected to an input of an AND gate 74, the output of which is connected to the count-down input of the counter 72. Another input of the AND gate 74 is connected to receive clock pulses CK from a suitable clock pulse generator which is not shown.

In operation, the print pulse $P_1$ is applied to the counter 72 causing the high output from the line 54, 56 or 57 to be latched into the counter 72 and be decoded. The initial count which is set into the counter 72 is equal to the number of clock pulses CK in the corresponding time interval t1, t2 or t3 respectively. The output of the counter 72 remains low since the instantaneous count in the counter 72 is equal to the latched-in value. The flip-flop 73 is reset from a previous operation producing a low output which inhibits the AND gate 74. Thus, the clock pulses CK are prevented from reaching and decrementing the counter 72.

The rising edge of the hammer drive pulse $P_3$ sets the flip-flop 73 which produces a high output enabling the AND gate 74. Thus, clock pulses CK are applied to the countdown input of the counter 72 causing the same to decrement and the output of the counter 72 to go high. The high output of the counter 72 is inverted by the inverter 46 and constitutes the inhibit pulse.

When the count in the counter 72 reaches zero, the output of the counter 72 goes low and the output of the inverter 46 goes high. In other words, the logically low inhibit pulse is terminated. The rising edge of the output signal of the inverter 46 resets the flip-flop 73 which produces a low output inhibiting the AND gate 74. Thus, no more clock pulses CK are gated to the counter 72 and the counter 72 is prevented from decrementing beyond zero.

Another printing parameter which influences the force of impact of the type element 12*c* or 12*d* against the paper 17 is the printing area of the selected type element. As an example, the printing area of the character "B" is greater than that of the character "1". As a result of the greater distribution of force over a larger printing area, the impact force per unit area is reduced as the printing area is increased. If the same amount of driving force is applied to the hammer 19 to print the characters "B" and "1", the character "B" will print lighter than the character "1". For this reason, it is also advantageous to vary the impact force as a function of the printing area of the selected character.

Although not shown, the basic circuit of FIG. 3 can accomplish this function with only minor modification. Specifically, the microswitches 41, 42 and 43 and inhibit decoder 44 may be omitted and signals corresponding to low, medium and large printing areas applied to the lines 54, 56 and 57 in accordance with the selected character. The signals may be generated in the type selection unit of the apparatus.

Figure 8:
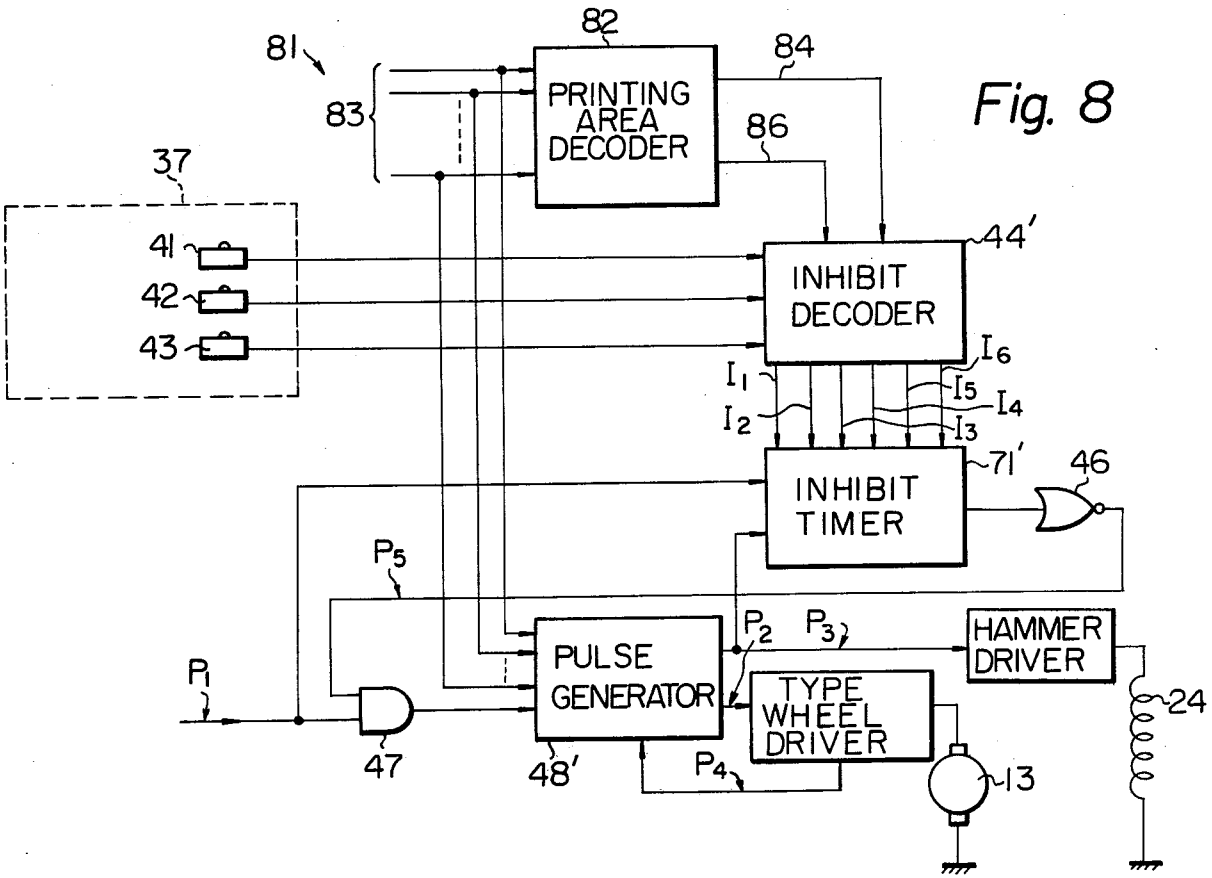
FIG. 8 is an electrical schematic diagram of a second embodiment of a printing apparatus of the present invention.

FIG. 8 shows a printing apparatus 81 which adjusts the distance between the type element 12 and platen 16 and the hammer inhibit time as functions of both the number of sheets of paper 17 and also the printing area of the selected character. Elements corresponding to those described hereinabove which perform the same functions are designated by the same reference numerals and will not be described repetitiously.

The printing apparatus 81 comprises a printing area decoder 82 which is adapted to receive inputs which are collectively designated as 83 from a type selection unit (not shown). The inputs 83 designate the selected character and are also fed to a slightly modified pulse generator 48' to rotate the type wheel 12 for character selection. The printing area decoder 82 produces a high output on a line 84 or 86 depending on whether the printing area of the selected character is small or large respectively. The pulse generator 48' also comprises a decoder (not shown) which causes the hammer drive pulse $P_3$ to have a larger magnitude for larger printing areas and thereby increase the impact force of the type element 12c or 12d against the paper 17.

The microswitches 41, 42 and 43 as well as the lines 84 and 86 are connected to inputs of a modified inhibit decoder 44', which has six outputs $I_1$ to $I_6$ connected to a modified inhibit timer 71' which correspond to inhibit durations t11 to t16 respectively.

Figure 9:
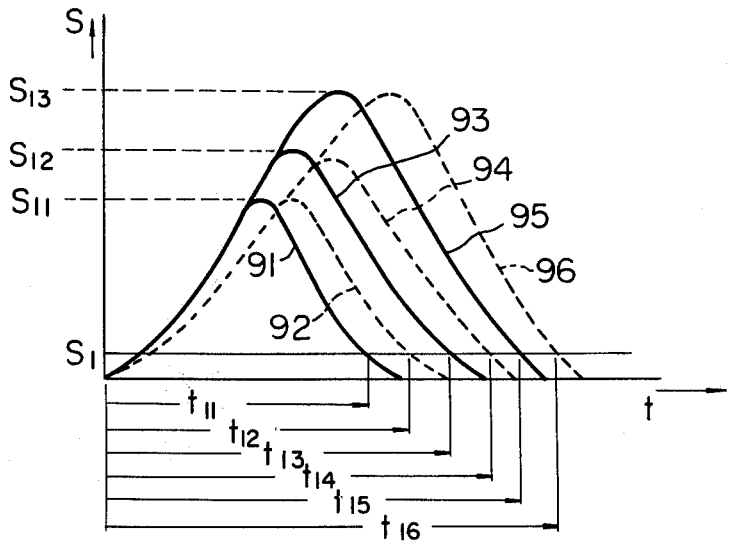
FIG. 9 is a graph illustrating the operation of the embodiment of FIG. 8.

In FIG. 9, curves 91, 93 and 95 show the displacement S of the hammer 19 with the signal on the line 86 (large printing area) logically high and the microswitches 41, 42 and 43 respectively closed. The hammer 19 moves through distances S11, S12 and S13 and returns to the distance S1 from the rest position in times t11, t13 and t15 respectively. FIG. 9 represents the maximum printing speed since the type wheel 12 may be rotated as the hammer 19 just clears the same after impact with the paper 17.

Curves 92, 94 and 96 represents the signal on the line 84 logically high (small printing area) and the microswitches 41, 42 and 43 respectively closed. It will be seen that since a smaller driving force is applied to the hammer 19 the same travels through the same distances S11, S12 and S13 as with the signal on the line 86 high but returns to the position S1 in longer time durations t12, t14 and t16 respectively.

The outputs $I_1$ to $I_6$ of the inhibit decoder 44' set the initial count in the inhibit timer 71' to correspond to the time durations t11 to t16 respectively. The initial count is latched into the inhibit timer 71' in response to the print pulse $P_1$ and the down-counting operation is initiated in response to the hammer drive pulse $P_3$. Thus, six different inhibit times are provided for the six possible combinations of the number of sheets and printing area described in this exemplary embodiment of the present invention.

In summary, it will be seen that the present invention provides a substantially improved impact printer in which the printing speed is increased by eliminating unnecessary hammer idle times. Various modifications will become possible for those skilled in the art after receiving the teachings of the present disclosure without departing from the scope thereof. For example, the numbers of increments of the number of sheets printed and the type printing area may vary from those shown and described. Further, the impact force of the type elements of the type wheel on the paper may be increased as the number of sheets is increased. This is carried out by moving the platen away from the type wheel so that the type element is accelerated to a greater speed before impact, thereby increasing the kinetic energy and impact force.

What is claimed is:

1. A printing apparatus comprising:

a type wheel including a rotary hub, a plurality of circumferentially spaced resilient arms radially extending from the hub and a plurality of type elements provided at end portions of the arms respectively;

type selection means for rotating the type wheel so that a selected type element occupies a printing position;

a printing hammer;

hammer drive means for driving the printing hammer to engage with and move the selected type element against paper for printing; and selection inhibit means for inhibiting the type selection means while the hammer is in engagement with the selected type element;

the hammer drive means comprising means for generating an electrical hammer drive signal to initiate driving of the hammer, the selection inhibit means comprising inhibit pulse generator means for generating an inhibit pulse having a predetermined duration in response to the hammer drive signal, the inhibit pulse inhibiting the type selection means for said duration;

the selection inhibit means being constructed to predetermine said duration of the inhibit pulse in accordance with a variable printing parameter of the printing apparatus.

2. A printing apparatus as in claim 1, in which said printing parameter is constituted by a number of sheets of said paper.

3. A printing apparatus as in claim 2, further comprising adjustment means for adjusting a distance between the type wheel and said paper in accordance with said number of sheets of said paper, the adjustment means being connected to the selection inhibit means in such a manner that said duration of the inhibit pulse is predetermined in accordance with a position of the adjustment means.

4. A printing apparatus as in claim 1, in which said printing parameter is constituted by a printing area of the selected type element.

5. A printing apparatus as in claim 1, in which the type selection means is constructed to initiate rotation of the type wheel in response to an electrical print signal, the apparatus further comprising gate means for gating the print signal to the type selection means, the gate means being inhibited by the inhibit pulse for said duration thereof.

6. A printing apparatus as in claim 1, in which the inhibit pulse generator means comprises a variable monostable multivibrator.

7. A printing apparatus as in claim 1, in which the inhibit pulse generator comprises a digital counter.

8. A printing apparatus as in claim 7, in which the digital counter is constructed to count down in response to clock pulses, an initial count being latched into the counter corresponding to a number of clock pulses in said duration of the inhibit pulse.

* * * * *